US011877623B2

(12) United States Patent
Hayden

(10) Patent No.: US 11,877,623 B2
(45) Date of Patent: Jan. 23, 2024

(54) SYSTEM OF GROUNDED SHOES AND GROUNDED FLOORS

(71) Applicant: Steven Mark Hayden, Reno, NV (US)

(72) Inventor: Steven Mark Hayden, Reno, NV (US)

( * ) Notice: Subject to any disclaimer, the term of this patent is extended or adjusted under 35 U.S.C. 154(b) by 0 days.

(21) Appl. No.: 17/690,426

(22) Filed: Mar. 9, 2022

(65) Prior Publication Data

US 2023/0284735 A1 Sep. 14, 2023

(51) Int. Cl.
*A43B 7/36* (2006.01)

(52) U.S. Cl.
CPC ..... *A43B 7/36* (2013.01)

(58) Field of Classification Search
CPC ..... A43B 7/36; A43B 21/36; A43B 21/42; A43B 21/44; A43B 21/52; A43B 21/54
USPC ..... 361/223, 224
See application file for complete search history.

(56) References Cited

U.S. PATENT DOCUMENTS 1,800,590 A * 4/1931 Bello ..... A43B 21/42 36/36 B
2,261,072 A * 10/1941 Monahan ..... A43B 7/36 361/224
2,745,041 A 5/1956 Price
2,955,234 A * 10/1960 Price ..... A43B 7/36 361/224
3,379,932 A 4/1968 Legge
3,596,134 A 7/1971 Burke
4,249,226 A * 2/1981 Westberg ..... A61N 1/14 361/223
4,812,948 A * 3/1989 Bird ..... A43B 7/36 361/223
4,978,700 A * 12/1990 Haygood ..... C08K 5/098 524/439
6,591,560 B2 * 7/2003 Burke, III ..... E04F 15/02 52/177
6,683,779 B2 1/2004 Ober
6,801,418 B1 10/2004 Epstein
10,327,417 B2 * 6/2019 Gaskill ..... A01K 1/035
10,398,193 B1 * 9/2019 Cheskin ..... A43B 13/04
2005/0016030 A1 * 1/2005 Cheskin ..... A43B 3/34 36/25 R
2008/0068773 A1 * 3/2008 Ober ..... A61N 1/14 361/220
2014/0254059 A1 * 9/2014 Kow ..... A43B 7/36 361/223

(Continued)

FOREIGN PATENT DOCUMENTS

CN 102438476 A * 5/2012 ..... A43B 17/00
KR 1862835 B1 * 5/2018 ..... A43B 3/101
WO WO-2021163768 A1 * 8/2021

*Primary Examiner* — Sharon M Prange

(57) ABSTRACT

A system for placing a person in electrical continuity with the ground in order to reduce the buildup of electric charge on a person's body. The system of the present invention comprises a shoe with an attached shoe grounding device and a plurality of grounded mats. The shoe grounding device is attached to the shoe in a manner that puts the interior surface of the body of the shoe in electrical continuity with the heel of the shoe. The heel of the shoe can be placed in electrical continuity with the ground by placing the heel of the shoe on top of any of the plurality of grounded mats, which are connected to the ground by a grounding wire. The system as a whole allows a person using the system to place themselves in electrical continuity with the ground.

13 Claims, 12 Drawing Sheets

(56) References Cited

U.S. PATENT DOCUMENTS

| | | | | |
|---|---|---|---|---|
| 2020/0323306 | A1* | 10/2020 | Ioannou | B32B 7/06 |
| 2021/0345474 | A1* | 11/2021 | Ioannou | A43B 7/36 |
| 2022/0408535 | A1* | 12/2022 | Eisenhardt | H05F 3/02 |

* cited by examiner

SYSTEM OF GROUNDED SHOES AND GROUNDED FLOORS

FIELD OF THE INVENTION

The present invention relates generally to systems for reducing electric charge on a body and specifically reducing electric charge through a system of conductive shoes and floors.

BACKGROUND OF THE INVENTION

Electrostatic charge can build up on a person through regular activity. This generally occurs when certain materials rub against one another. Materials such as wool, fur, glass, human hair, and nylon tend to lose electrons when in contact with other materials, while materials such as rubber, silicone, and plastic tend to gain electrons when in contact with other materials. Thus, when a material that tends to lose electrons rubs against a material that tends to gain electrons, electrons are transferred, and each material gains an opposite charge. For example, a person walking on a vinyl floor with rubber-soled shoes may become negatively charged or a person brushing against something plastic while wearing a wool sweater may become positively charged. In situations such as these, the person may stay charged and build up additional charge until grounded.

Various issues may arise from the buildup of electrostatic charge on a person's body. If enough charge builds up on a person, a painful shock can occur when the person is eventually grounded if precautions are not taken. Additionally, carrying charge on one's body can have an effect on particles interacting with the person's body due to the greater effect an electrical charge has on particles with smaller masses. In particular, when a person's body is similarly charged to the particles of lung pathogens, those particles may be more easily expelled from the body since they are repelled from the walls of the person's respiratory tract, leading to increased spread of the pathogen. In some cases, an infection isolated to a single lung may spread to the other lung while talking, snoring, singing, etc. since a portion of each exhaled breath is re-inhaled, causing exhaled viral particles from one lung to be re-inhaled to the other lung. Further, certain electronics can be adversely affected by even small electrostatic discharges. Due to this, carrying an unnoticeable charge on one's body may cause one do unknowingly damage certain electronics through contact. These and other disadvantages associated with carrying a charge on one's body display the need to regularly ground people and remove the charge from their body.

Some devices have been created for avoiding electrostatic discharge, particularly around sensitive electronics. Most commonly, anti-static wrist straps are used. These straps connect to a person's wrist at one end and connect to a grounded conductor at the other end. Other devices include anti-static mats, upon which a person stands barefoot to remain grounded while working. These devices allow one to work with sensitive electronics while remaining grounded at all times. While these devices can successfully ground a person, they require the active decision to utilize them before a certain task and do not keep a person grounded as they move about their day.

One situation that may unfortunately lead to increased buildup of charge on people's bodies is in a hospital. Hospitals tend to utilize vinyl, rubber, or linoleum flooring since it is durable and easy to clean. However, such materials tend to insulate those who interact with them and in some cases may actually lead to a buildup of charge based on the materials worn by those interacting with the floor. Similar flooring is commonly used in schools and gyms, leading to a great number of people being unnecessarily insulated throughout their day. In addition to these insulated floors, most shoes are also made of insulating materials, meaning that even if one steps onto a grounded surface, discharge may not occur. This combination of insulated footwear and flooring leads to people in hospitals, schools, gyms, and many other places holding a charge on their body throughout the day, potentially causing eventual painful discharges and increased spread of disease.

Thus, there is a need for a system of flooring and footwear that allows people to regularly and passively discharge their bodies. The system of the present invention provides a system and apparatuses for regularly discharging oneself in a fast, convenient, and effective manner.

SUMMARY OF THE INVENTION

The present invention is a system for electrically grounding a person, comprising a shoe, a shoe grounding device, and a plurality of grounded mats. The shoe grounding device of the present invention is a conductive article that attaches to the shoe, placing at least part of the interior surface of the shoe in electrical continuity with bottom of the heel of the shoe. The plurality of grounded mats of the present invention each have a conductive top surface connected to the ground by a grounding wire. The shoe, shoe grounding device, and grounding mats work as a system to place the interior surface of the shoe in electrical continuity with the ground when the heel of the shoe is placed on the top surface of one of the grounded mats. When used by a person, the system of the present invention allows the person to ground themselves by wearing the shoe and stepping on one of the grounded mats.

DETAIL DESCRIPTIONS OF THE INVENTION

Figure 1:
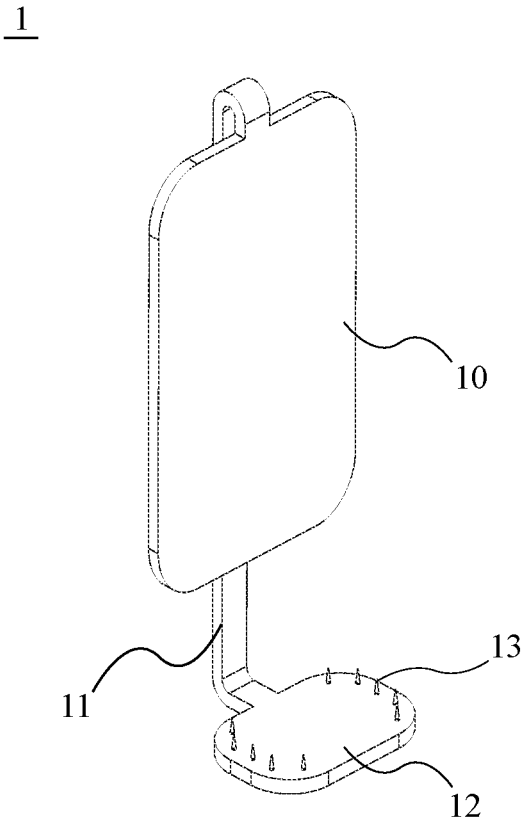
FIG. 1 is a top front isometric view of the shoe grounding device of the present invention in accordance with at least one embodiment.

All illustrations of the drawings are for the purpose of describing selected versions of the present invention and are not intended to limit the scope of the present invention.

It is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings. Accordingly, the following detailed description does not limit the disclosure. Instead, the proper scope of the disclosure is defined by the appended claims.

The present invention is a system for reducing the buildup of electric charge on a human body. The system of the present invention comprises a shoe 2, a capacitor 4, a shoe grounding device 1 and one or more grounded mats 3. In use, the shoe 2 of the present invention is worn on the user's foot and the shoe grounding device 1 is attached to the shoe 2, allowing the user's body to discharge when the shoe 2 comes into contact with a grounded conductive surface. In the present invention, the one or more grounded mats 3 act as a grounded conductive surface.

Like any electrically conductive object, a human body is capable of storing electric charge if insulated. Common friction with synthetic fabrics can charge a human body to a few kV and the charge may be significantly higher under ideal conditions or when done purposely. While electrostatic discharge under such conditions is often unnoticeable, the build up of charge on the body can have effects on particles travelling through the body. Particles with smaller mass are more affected by charge, meaning that although the charge on a human body may be unnoticeably small to a person, it can still act to attract and repel particles travelling through the body.

Figure 4:
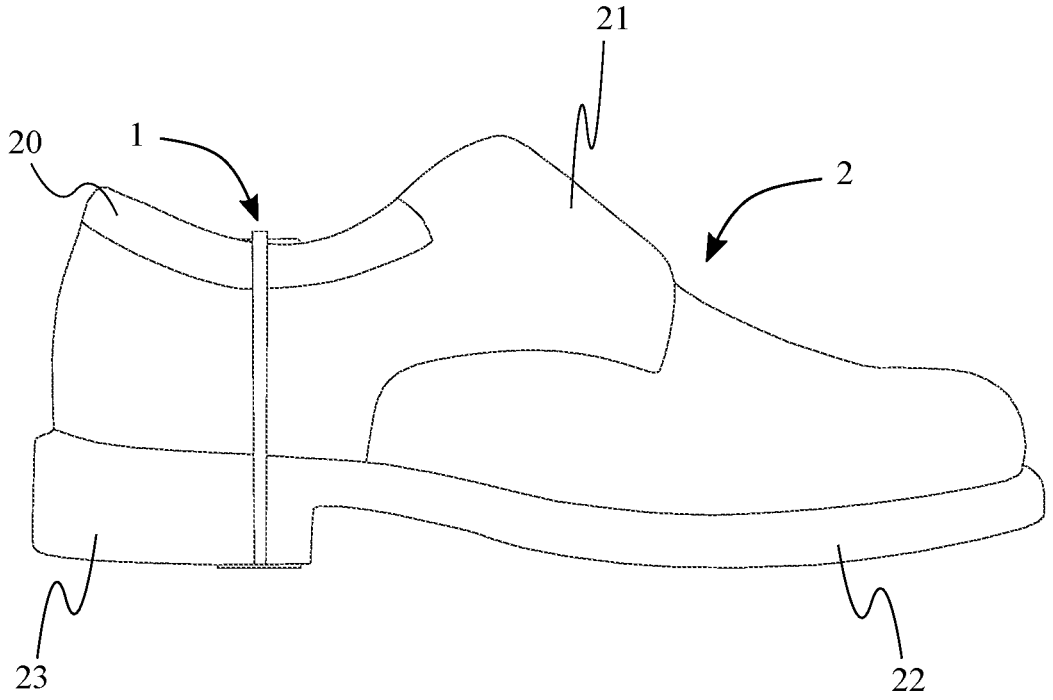
FIG. 4 is a right-side elevation view of the shoe grounding device of the present invention connected to the shoe in accordance with at least one embodiment.
Figure 5:
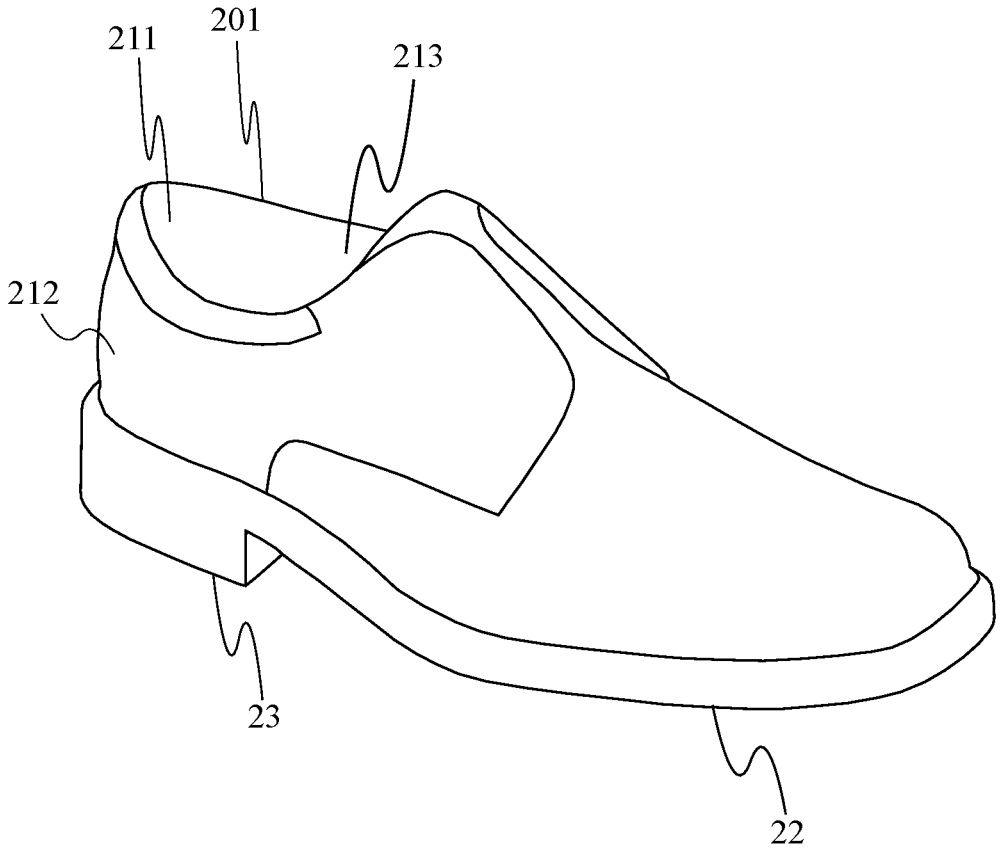
FIG. 5 is a top front isometric view of the shoe of the present invention in accordance with at least one embodiment.

Referring to FIGS. 4 and 5, the shoe 2 of the present invention may be designed like any traditional shoe, having at least a body 21 with a front end and a back end, a topline 20, and a sole 22 with a heel 23. The sole 22 has a top surface and a bottom surface and is connected to the body 21 of the shoe 2 so that an interior area of the shoe 2 is created by the interior surface 211 of the body 21 and the top surface of the sole 22. When worn on the user's foot, the bottom of the user's foot rests on the top surface of the sole 22 with the user's ankle being substantially encircled by the topline 20. The user's toes are positioned at the front end of the body 21 and the user's heel is positioned at the back end of the body 21. The back of the user's ankle or calf may stay in regular contact with the back edge of the topline 20 of the shoe 2. While walking, the bottom surface of the sole 22 may make contact with the ground with each step taken.

Figure 6:
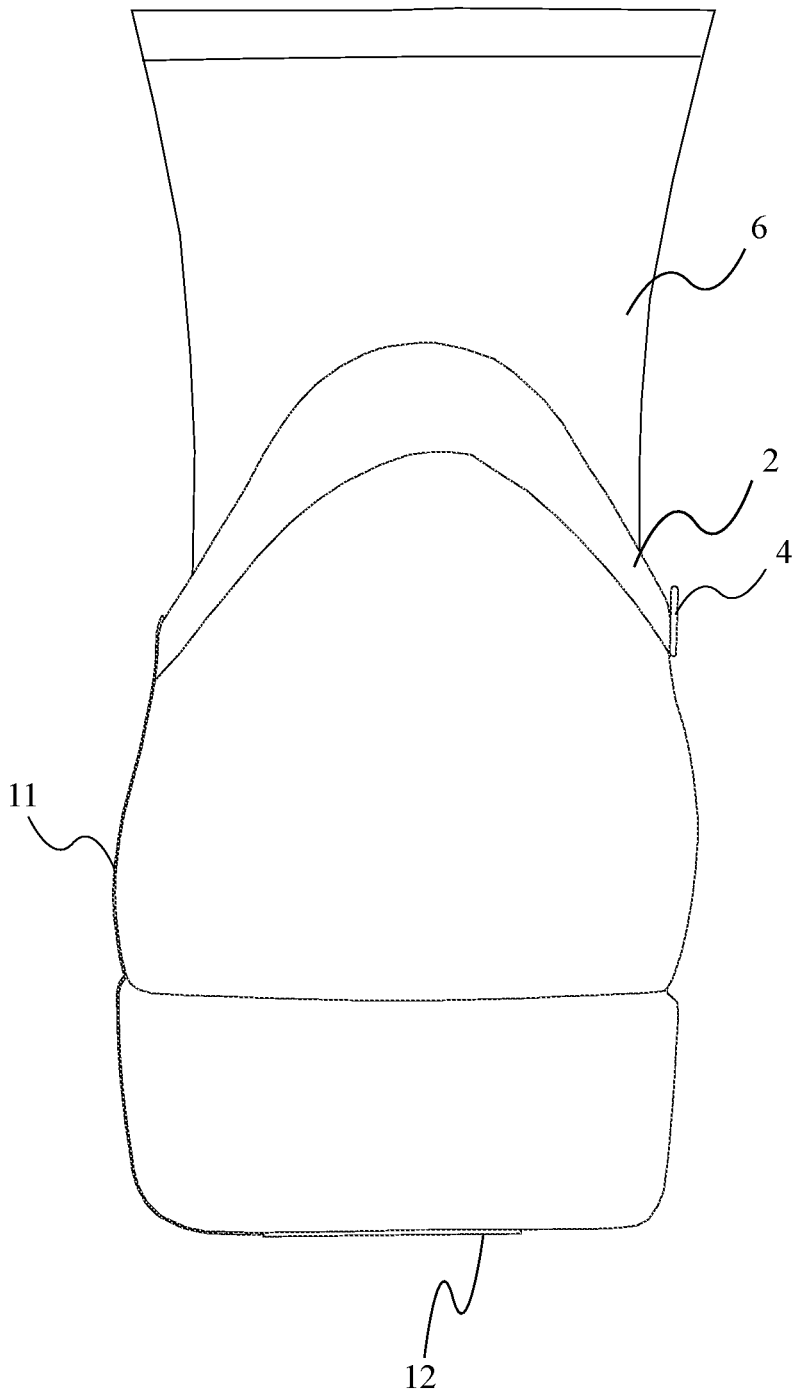
FIG. 6 is a rear elevation view of the shoe grounding device, capacitor, and conductive sock of the present invention in accordance with at least one embodiment.

The capacitor 4 of the present invention is a traditional capacitor, having a positive connection, a negative connection, two conductive plates, an insulating dielectric, and insulated body. The conductive plates are separated by the insulating dielectric and surrounded by the insulated body. The positive connection and negative connection are each connected to one of the two conductive plates and are exposed from the insulated body. The capacitor 4 is positioned in the shoe 2 so that the positive and negative connections face toward the interior of the shoe 2. In one embodiment shown in FIG. 6, the capacitor 4 is clipped to the topline 20 of the shoe 2 at the medial edge of the shoe 2 body, though other attachment mechanisms may be used to secure the capacitor 4 to the shoe 2. When the shoe 2 is worn by the user, the side of the user's ankle or calf may stay in contact with both the positive and negative connections of the capacitor 4 or may regularly contact the capacitor 4 while moving.

Figure 2:
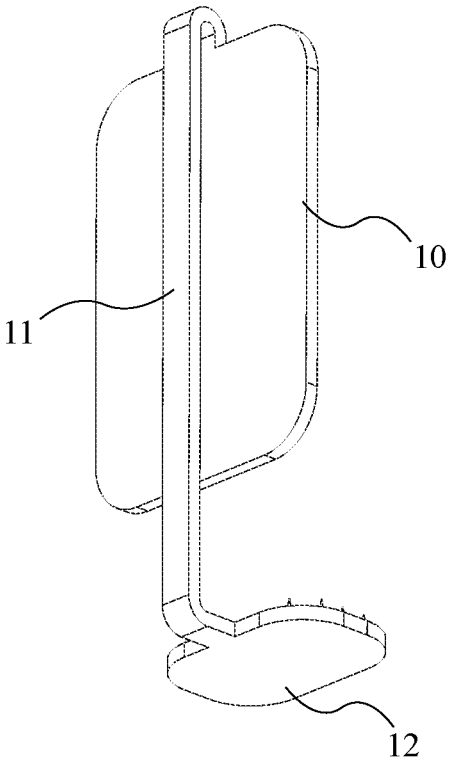
FIG. 2 is a bottom rear isometric view of the shoe grounding device of the present invention in accordance with at least one embodiment.
Figure 3:
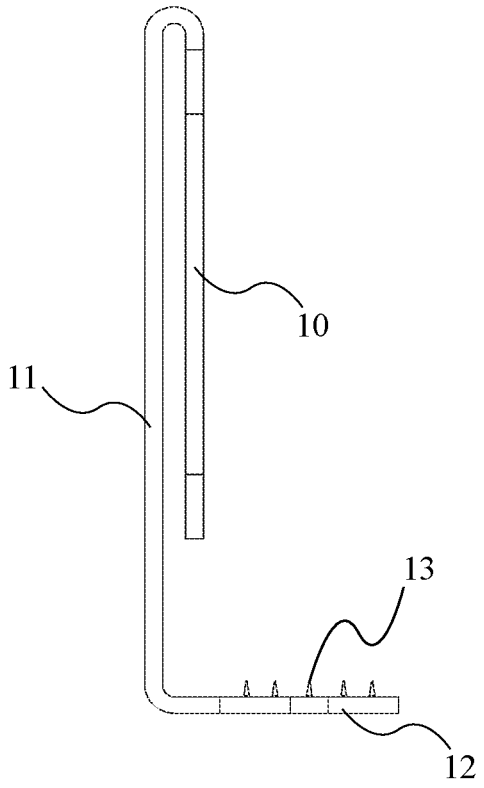
FIG. 3 is a right-side elevation view of the shoe grounding device of the present invention in accordance with at least one embodiment.

Referring to FIGS. 1, 2 and 3, the shoe grounding device 1 the present invention includes a contact plate 10, a grounding plate 12, and a conductive strap 11. The contact plate 10 of the shoe grounding device 1 is a thin piece of conductive material embedded in the interior surface of the shoe 2. In the preferred embodiment, the contact plate 10 is embedded in the lateral interior surface 213 of the shoe body 21 near the topline 20 of the shoe 2, though the contact plate 10 may cover any portion of the interior surface 211 of the shoe 2. The grounding plate 12 of the shoe grounding device 1 is a thin piece of conductive material embedded into the exterior surface of the shoe 2, on the sole 22. In the preferred embodiment, the grounding plate 12 is embedded in the heel 23 of the sole 22. The conductive strap 11 of the shoe grounding device 1 is a strip of conductive material connecting the contact plate 10 to the grounding plate 12. In the preferred embodiment, the conductive strap 11 connects to the contact plate 10 at the lateral edge 201 of the topline 20 of the shoe 2, extends along the lateral exterior surface 212 of the of the shoe 2, and connects to the grounding plate 12 at the heel 23. The conductive strap 11 is a strip of conductive fabric in the preferred embodiment, though it may also be a strip of conductive tape or thin, flexible strip of metal. The contact plate 10, grounding plate 12, and conductive strap 11 may each have attaching mechanisms to secure them to the appropriate areas of the shoe 2. In the preferred embodiment, these attaching mechanisms are a series of pins 13 that can be pressed into the material of the shoe 2. In other embodiments the attaching mechanisms may be adhesives, hook and loop fasteners, or other attachment types. Further, the contact plate 10, grounding plate 12, and conductive straps 11 may each use different attachment mechanisms in the same embodiment. For example, the grounding plate 12 may be hammered into the heel 23 of the shoe 2 with pins 13, the conductive strap 11 may be attached to the body 21 of the shoe 2 with hook and loop fasteners, and the contact plate 10 may be adhesively stuck to the interior area of the shoe 2 all in the same embodiment.

In an alternative embodiment of the shoe 2, the shoe grounding device 1 may be manufactured as a built-in part of the shoe 2. One such embodiment may use conductive fabric as a contact plate 10 on the entire interior area of the shoe 2 with the conductive strap 11 extending through the sole 22 of the shoe 2 to connect the contact plate 10 to the grounding plate 12 on the heel 23 of the shoe 2.

Figure 7:
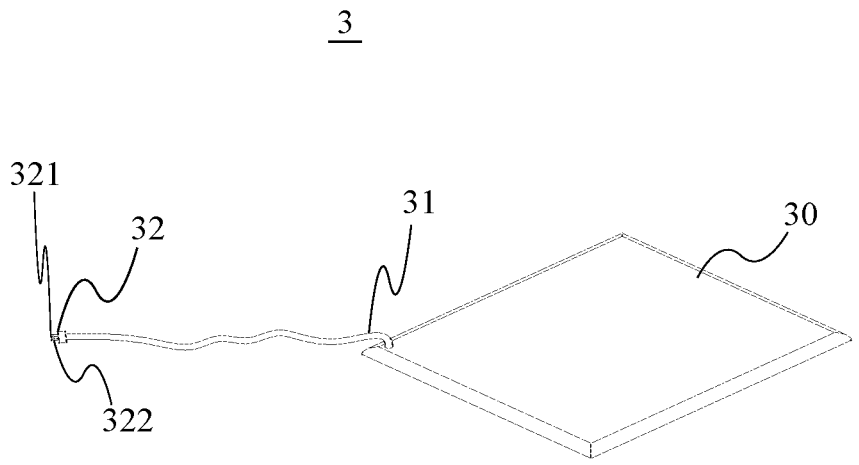
FIG. 7 is a top front isometric view of the a grounded mat of the present invention in accordance with at least one embodiment.
Figure 8:
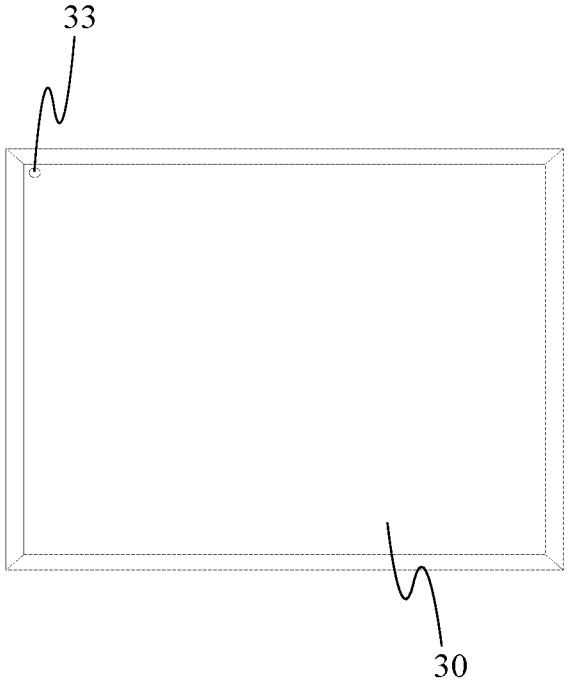
FIG. 8 is a top plan view of a grounded mat of the present invention in accordance with at least one embodiment.

Referring to FIGS. 7 and 8, each of the grounded mats 3 of the present invention comprise a top surface 30, a bottom surface, and a grounding wire 31. The top surface 30 of the grounded mat 3 is a flat conductive material. The bottom surface of the grounded mat 3 may be any material, but in the preferred embodiment it is a ductile and pliable material such as rubber or silicone, creating a non-slip interaction with most flooring. In addition, the bottom surface of the grounded mat 3 may be rough or include an embossed pattern to further reduce slip with the floor. The grounding wire 31 of the grounded mat 3 has a first end 311 and a second end 312. The first end 311 of the grounding wire 31 attaches to the top surface 30 of the grounded mat 3 at any point along the mat so that the top surface 30 is in electrical continuity with the grounding wire 31. In one embodiment, the top surface 30 of the grounded mat 3 may include cavities 33 in which the grounding wire 31 can be inserted and secured with a screw. The second end 312 of the grounding wire 31 is connected to an electrical ground 51. In some embodiments, the electrical ground 51 may include a plurality of contact openings 511 and a ground port 512. The second end 312 of the grounding wire 31 may include a ground plug adapter 32 to allow a secure connection between the second end 312 of the grounding wire 31 and the electrical ground 51. The ground plug adapter 32 comprises a plurality of insulating prongs 321 and a grounding prong 322. In the preferred embodiment of the present invention, the grounding wire 31 is attached to the electrical ground 51 by inserting the plurality of insulating prongs 321 into the plurality of contact openings 511 of the outlet 51 and inserting the grounding prong 322 into the ground port 512 of the outlet 51.

Figure 11:
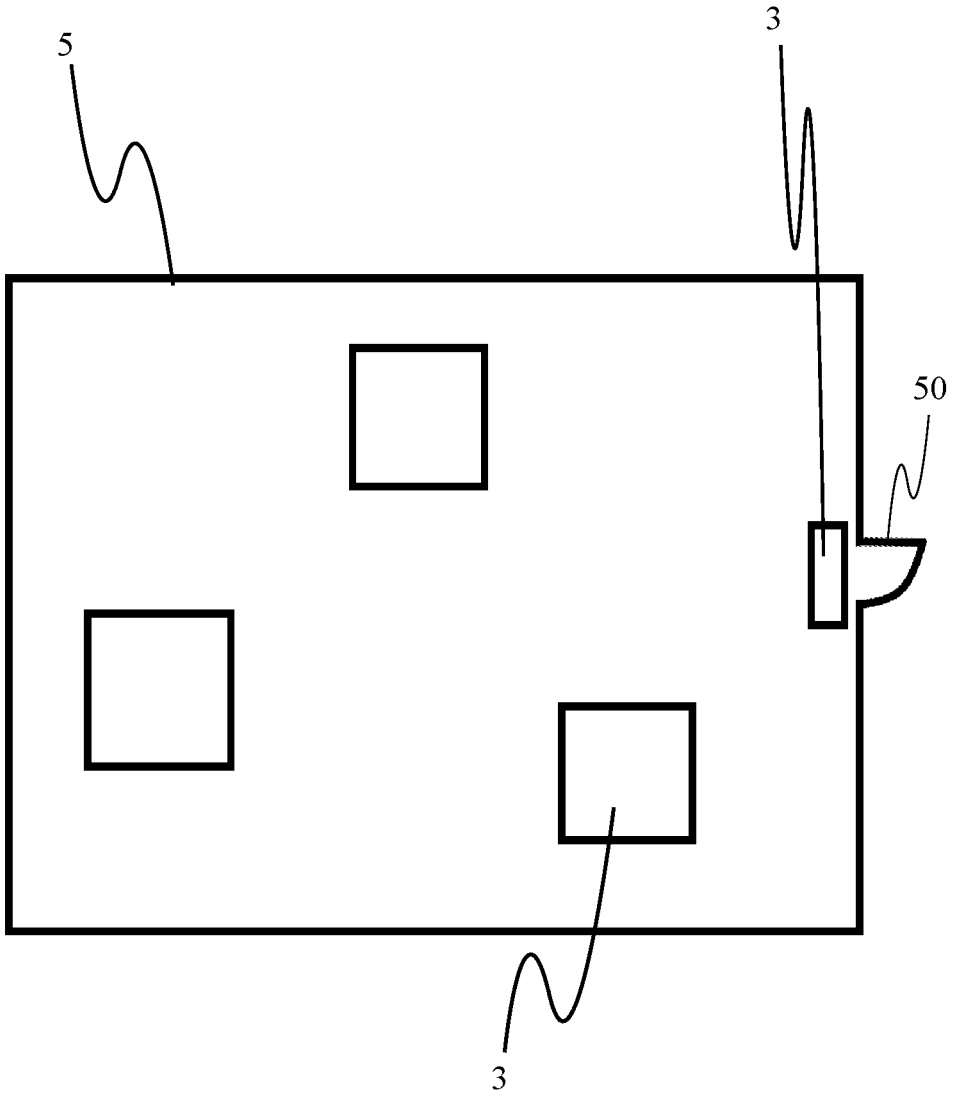
FIG. 11 is an illustration of the layout of a room with multiple grounded mats of the present invention in accordance with at least one embodiment.

The grounded mats 3 of the present invention may come in a variety of shapes and sizes depending upon the use made of the system. In one embodiment of the present invention shown in FIG. 11, a single grounded mat 3 is used at the doorway 50 of a room 5. In this embodiment, the grounded mat 3 may be substantially rectangular in shape and placed at the entrance or exit of the room 5.

Figure 9:
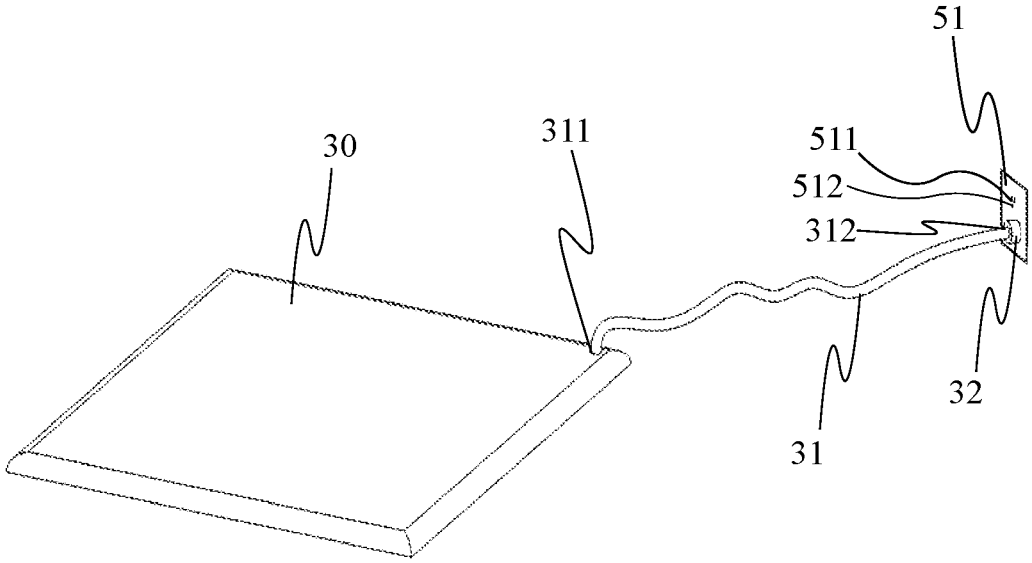
FIG. 9 is an illustration of a grounded mat of the present invention connected to an outlet in accordance with at least one embodiment.
Figure 12:
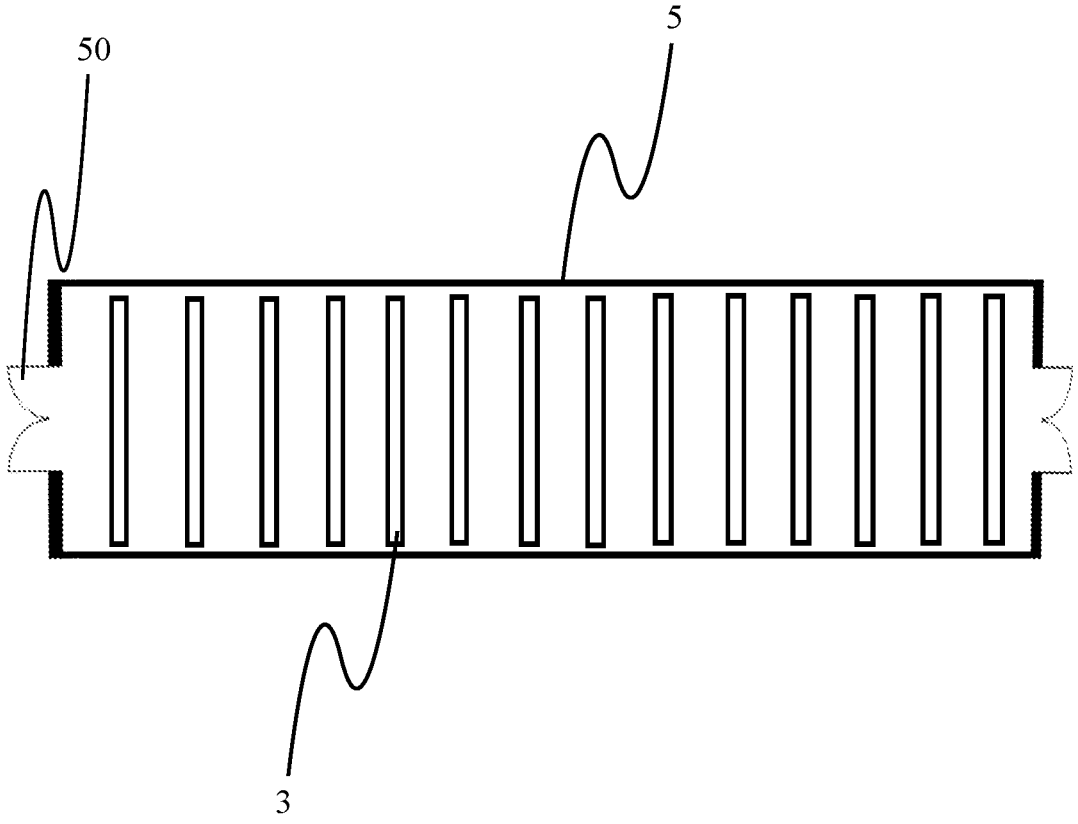
FIG. 12 is an illustration of the layout of a room with multiple grounded mats of the present invention in accordance with at least one embodiment.

In other embodiments, one or more grounded mats 3 may be placed in any at predetermined positions within a room 5 instead of or in addition to the grounded mat 3 at the entrance or exit. These grounded mats 3 may be placed at areas of particular importance in the room 5 such as a spot where people commonly walk or stand or a spot near a conductive surface that could cause a shock if contacted by an electrically charged person. In one embodiment of the present invention shown in FIG. 12, the grounded mats 3 are thin rectangular strips long enough to stretch from one end of the room 5 to the opposite end of the room 5. These grounded mats 3 are placed parallel to one another at regular intervals across the room 5 so that a person walking from one end of the room 5 to the opposite end of the room 5 would naturally make contact with one or more of the mats. In another embodiment, the mat may be the same size as the room 5 so that it covers the entire floor, allowing anyone in the room 5 to stay grounded in any part of the room 5. In any configuration of grounded mats 3, each of the grounded mats 3 must be connected to the ground by the grounding wire 31. This is preferably done by plugging the second end of the grounding wire 31 into the ground port 52 of an outlet 51, as shown in FIG. 9. In the case of multiple grounded mats 3 in the same room 5, the second end of the grounding wire 31 of one grounded mat 3 may be connected to the top surface 30 of another grounded mat 3 that is in electrical continuity with the ground.

In addition to placing grounded mats at particular locations on the floor of a room, various other uses can be made of the grounded mats to keep users grounded while not walking or standing on the floor. The grounded mats 3 of the present invention allow a user to be placed in electrical continuity with the ground by making physical contact with the grounded mat 3 even if not wearing the shoe 2 of the present invention. So long as a user is not wearing insulated clothing that prevents the flow of electricity between themselves and the grounded mat 3, the user may be grounded by contacting the grounded mat 3. Thus, the grounded mats 3 of the present invention can be used in areas other than the floor to ground the user. For example, the grounded mats 3 may be integrated into a mattress or sheet to ground the user while they sleep. Such a use is important to limit exhalation of charged particles through snoring. Additionally, the grounded mats 3 may be integrated into chairs, stools, or other furniture to keep the user grounded while sitting. Since charge can be picked up on a person through shifting around on the material of a bed, chair, stool, etc., the grounded mats must be able to be used for grounding users even when not walking with the shoe 2 of the present invention.

Figure 10:
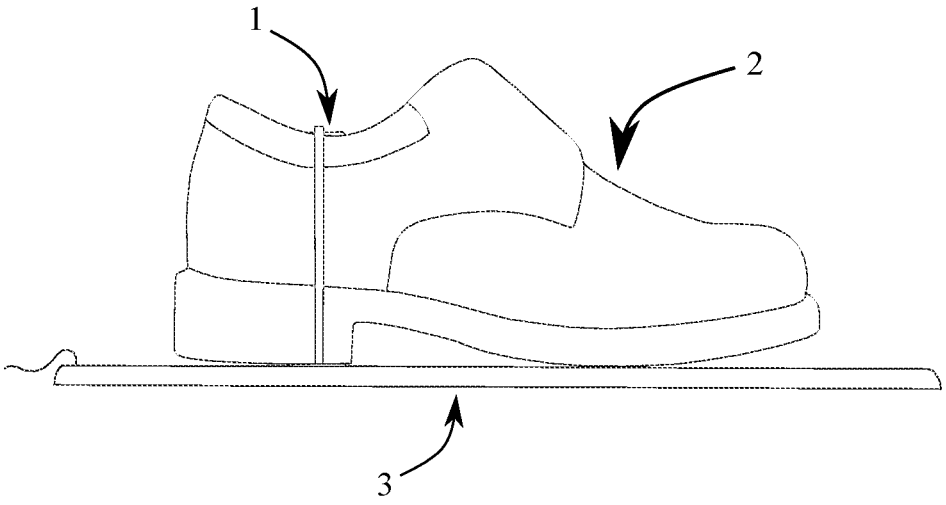
FIG. 10 is an illustration of the shoe grounding device of the present invention interacting with the grounded mat of the present invention in accordance with at least one embodiment.

In use, the system and apparatuses of the present invention allow a person to regularly place themselves in electrical continuity with the ground without having to actively seek out a means of grounding themselves. The user of the present invention configures the shoe 2 and the shoe grounding device 1 for use with the user's foot. In some embodiments, the shoe grounding device 1 may be part of the shoe 2, but in embodiments in which the shoe grounding device 1 is separate from the shoe 2, the user must attach the grounding plate 12 to the heel 23 of the shoe 2, secure the conductive strap 11 to the exterior surface of the body 21 of the shoe 2, and attach the contact plate to the interior surface of the body 21 of the shoe 2. The user must also attach the capacitor 4 to the shoe 2. In some embodiments, the user may also wear a conducting sock 6 between the user's foot and the shoe 2 to provide greater conductivity in the system as a whole. Once the shoe 2, shoe grounding device 1, and capacitor 4 are correctly configured, the user may secure the shoe 2 and attached components to the user's foot. While wearing these components, the user may pick up an electric charge, which is then primarily stored in the capacitor 4. The one or more grounded mats 3 of the present invention are installed in a predetermined orientation to most effectively ground the user without significantly hampering use of the room 5. Once the grounded mats 3 are installed, the user may move about the room 5. When the user steps on one of the grounded mats 3 as shown in FIG. 10, the user's body and the capacitor 4 are placed in electrical continuity with the ground. This electrical continuity with the ground comes from the connection of the capacitor 4 to the user's body, the user's body to the contact plate 10, the contact plate 10 to the conductive strap 11, the conductive strap 11 to the grounding plate 12, the grounding plate 12 to the top surface 30 of the grounded mat 3, the top surface 30 of the grounded mat 3 to the grounding wire 31, and the grounding wire 31 to the ground. Once the user is in electrical continuity with the ground, the user's body and the capacitor 4 are discharged, returning the user to a substantially neutral state.

Although the invention has been explained in relation to its preferred embodiment, it is to be understood that many other possible modifications and variations can be made without departing from the spirit and scope of the invention.

What is claimed is:

1. An electrical grounding system comprising:

a shoe;

a shoe grounding device;

the shoe further comprising a shoe body, a topline, a sole, and a heel;

the topline partially encircling an opening in the shoe body;

the sole connected to the shoe body opposite the topline;

the heel connected to the sole;

the shoe body having an interior surface and an exterior surface;

the shoe grounding device further comprising a contact plate, a grounding plate, and a conductive strap;

the conductive strap connecting the grounding plate to the contact plate;

the contact plate of the shoe grounding device connected to the interior surface of the shoe body;

the grounding plate of the shoe grounding device connected to the heel of the shoe;

the conductive strap of the shoe grounding device connected to the exterior surface of the shoe body;

a capacitor;

the capacitor attached to the topline of the shoe; and the capacitor configured to be electrically connected with the interior surface of the shoe body.

2. The electrical grounding system of claim 1, further comprising:

the contact plate of the shoe grounding device connecting to the lateral interior surface of the shoe body;

the contact plate of the shoe grounding device configured to be electrically connected with the interior surface of the shoe body;

the conductive strap of the shoe grounding device connecting to the contact plate at the lateral edge of the topline of the shoe;

the conductive strap of the shoe grounding device connecting to the lateral exterior surface of the shoe body; and the conductive strap of the shoe grounding device connecting to the grounding plate at the lateral edge of the heel of the shoe.

3. The electrical grounding system of claim 1, further comprising:

a plurality of pins;

the plurality of pins arranged on the grounding plate of the shoe grounding device; and the grounding plate of the shoe grounding device connecting to the shoe by embedding the plurality of pins in the heel of the shoe.

4. The electrical grounding system of claim 1, further comprising:

a conductive sock; and the conductive sock arranged in the shoe and configured to be electrically connected with the interior surface of the shoe body.

5. The electrical grounding system of claim 1, further comprising:

one or more grounding mats;

an electrical ground;

each of the one or more grounding mats comprising a top surface and a grounding wire in electrical continuity with the top surface;

the grounding wire of each grounding mat being connected to the electrical ground; and each grounding mat being configured to place the contact plate of the shoe grounding device in electrical continuity with the electrical ground when the grounding plate of the shoe grounding device makes contact with the top surface of any of the one or more grounding mats.

6. The electrical grounding system of claim 5, further comprising:

each of the one or more grounded mats further comprising a cavity on the top surface; and the grounding wire of each of the one or more grounded mats connecting to the top surface at the cavity.

7. The electrical grounding system of claim 5, further comprising:

the grounding wire having a first end and a second end;

the second end of the grounding wire further comprising a ground plug adapter;

the ground plug adapter having a plurality of insulating prongs and a grounding prong;

the electrical ground having a plurality of contact openings and a ground port; and the second end of the grounding wire connecting to the electrical ground by inserting the plurality of insulating prongs into the contact openings and inserting the grounding prong into the ground port.

8. An electrical grounding system comprising:

one or more grounding mats;

an electrical ground;

each of the one or more grounding mats comprising a top surface and a grounding wire electrically connected with the top surface;

the grounding wire of each grounding mat being connected to the electrical ground;

a shoe;

a shoe grounding device;

the shoe further comprising a shoe body, a topline, a sole, and a heel;

the topline substantially encircling an opening in the shoe body;

the sole connected to the shoe body opposite the topline;

the heel connected to the sole;

the shoe body having an interior surface and an exterior surface;

the shoe grounding device further comprising a contact plate, a grounding plate, and a conductive strap;

the conductive strap connecting the grounding plate to the contact plate;

the contact plate of the shoe grounding device connected to the interior surface of the shoe body;

the grounding plate of the shoe grounding device connected to the heel of the shoe;

the conductive strap of the shoe grounding device connected to the exterior surface of the shoe body;

each grounding mat being configured so the contact plate of the shoe grounding device is electrically connected with the electrical ground when the grounding plate of the shoe grounding device makes contact with the top surface of any of the one or more grounding mats;

a capacitor;

the capacitor attached to the topline of the shoe; and the capacitor configured to be electrically connected with the interior surface of the shoe body.

9. The electrical grounding system of claim 8, further comprising:

each of the one or more grounding mats further comprising a cavity on the top surface; and the grounding wire of each of the one or more grounding mats connecting to the top surface at the cavity.

10. The electrical grounding system of claim 8, further comprising:

the grounding wire having a first end and a second end;

the second end of the grounding wire further comprising a ground plug adapter;

the ground plug adapter having a plurality of insulating prongs and a grounding prong;

the electrical ground having a plurality of contact openings and a ground port; and the second end of the grounding wire connecting to the electrical ground by inserting the plurality of insulating prongs into the contact openings and inserting the grounding prong into the ground port.

11. The electrical grounding system of claim 8, further comprising:

the contact plate of the shoe grounding device connecting to the lateral interior surface of the shoe body;

the contact plate of the shoe grounding device configured to be electrically connected with the interior surface of the shoe body;

the conductive strap of the shoe grounding device connecting to the contact plate at the lateral edge of the topline of the shoe;

the conductive strap of the shoe grounding device connecting to the lateral exterior surface of the shoe body; and the conductive strap of the shoe grounding device connecting to the grounding plate at the lateral edge of the heel of the shoe.

12. The electrical grounding system of claim 8, further comprising:

a plurality of pins;

the plurality of pins arranged on the grounding plate of the shoe grounding device; and the grounding plate of the shoe grounding device connecting to the shoe by embedding the plurality of pins in the heel of the shoe.

13. The electrical grounding system of claim 8, further comprising:

a conductive sock; and the conductive sock arranged in the shoe and configured to be electrically connected with the interior surface of the shoe body.

* * * * *